US006321834B1

(12) United States Patent
Higashiyama

(10) Patent No.: US 6,321,834 B1
(45) Date of Patent: Nov. 27, 2001

(54) LAMINATE-TYPE HEAT EXCHANGER

(75) Inventor: Naohisa Higashiyama, Tochigiken (JP)

(73) Assignee: Showa Denko K.K., Tokyo (JP)

( * ) Notice: Subject to any disclaimer, the term of this patent is extended or adjusted under 35 U.S.C. 154(b) by 0 days.

(21) Appl. No.: 09/672,737

(22) Filed: Sep. 28, 2000

(30) Foreign Application Priority Data

Oct. 1, 1999 (JP) ..... 11-281024

(51) Int. Cl.[7] ..... F28D 1/03; F28F 9/22

(52) U.S. Cl. ..... 165/153; 165/174; 165/176; 62/525

(58) Field of Search ..... 165/153, 174, 165/176; 62/515, 525, 524, 526

(56) References Cited

U.S. PATENT DOCUMENTS 4,589,265 * 5/1986 Nozawa ..... 62/526
6,070,428 * 6/2000 Higashiyama et al. ..... 62/525

FOREIGN PATENT DOCUMENTS 2-50059 * 2/1990 (JP) ..... 62/515

* cited by examiner

*Primary Examiner*—Leonard Leo

(57) ABSTRACT

A laminate-type heat exchanger includes a core 10 formed by a plurality of plate-shaped tubular elements 20 laminated in a thickness direction thereof. Each tubular element 20 is provided with two refrigerant passages 25*a* and 25*b* extending in a longitudinal direction thereof and arranged fore and aft. The core 10 includes a plurality of passes P1 to P4 each formed by a prescribed number of the refrigerant passages arranged in the width direction of the core 10 and a turn portion T formed between the upper portions of the second pass P2 and the third pass P3. At a prescribed portion of the turn portion T, a refrigerant flow resisting portion including a semi-restricting passage 43 and/or an interrupting passage 44 is provided. The refrigerant passed through the second pass P2 is restricted by the refrigerant flow resisting portion when passing through the turn portion T to be equally distributed. Then, the refrigerant is introduced into the third pass P3 in an equally distributed manner.

11 Claims, 16 Drawing Sheets

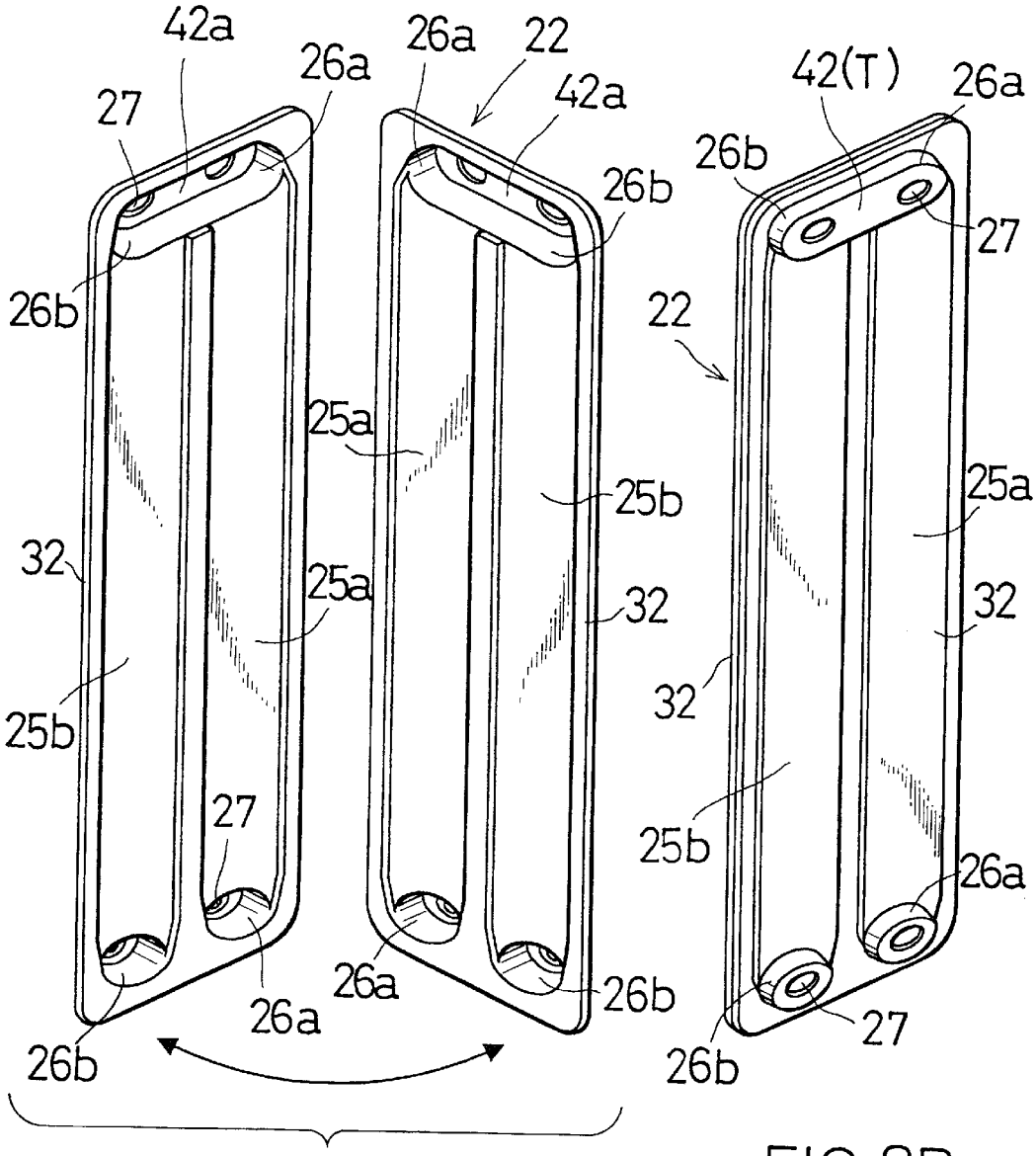
FIG.8A
FIG.8B
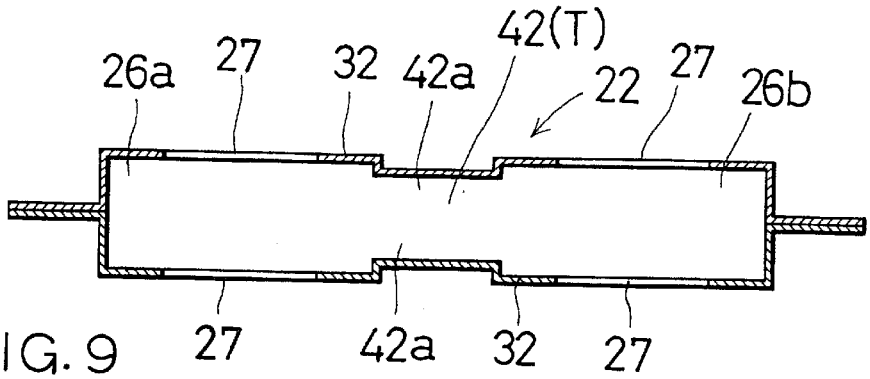
FIG.9

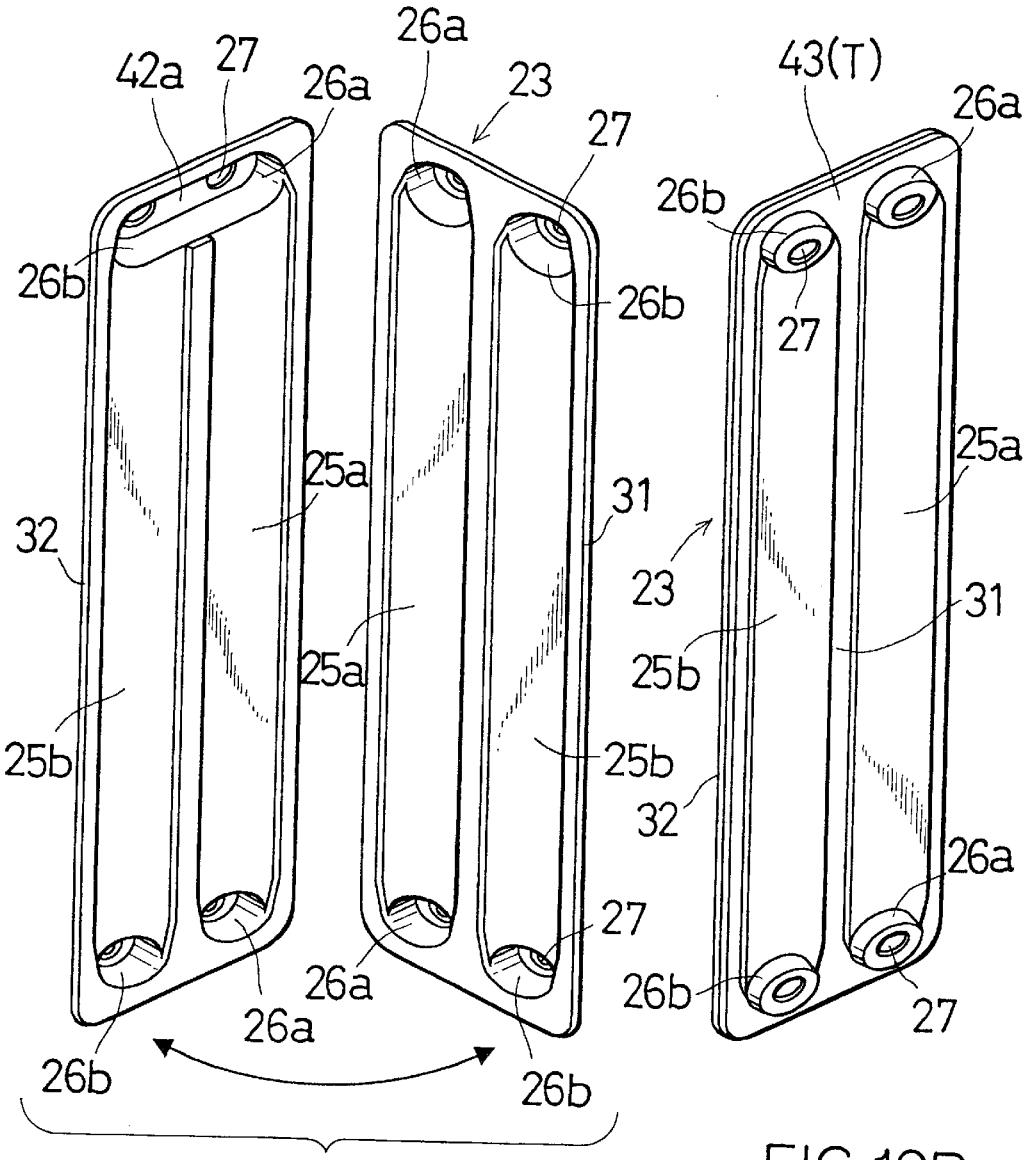
FIG.10A
FIG.10B
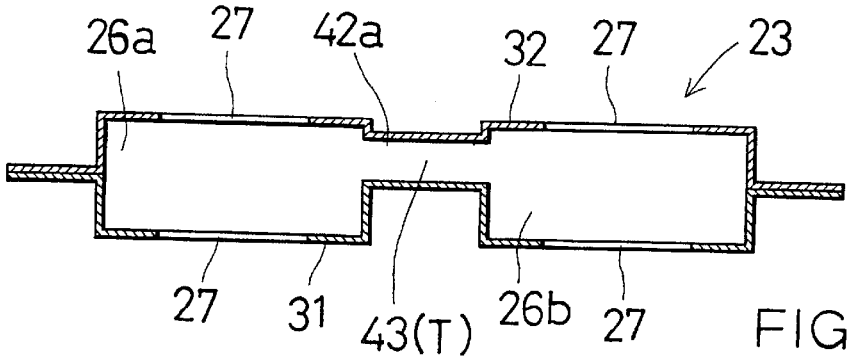
FIG.11

LAMINATE-TYPE HEAT EXCHANGER

BACKGROUND OF THE INVENTION

1. Field of the Invention

The present invention relates to a laminate-type heat exchanger preferably used as a heat exchanger such as an evaporator for use in an automobile air conditioning system.

2. Description of Related Art

Conventionally, a so-called laminate-type heat exchanger is well known as an evaporator for use in an automobile air conditioning system. As shown in FIGS. 23 to 25, the evaporator has a core 1 comprised of a plurality of tubular elements 2 laminated in the thickness direction thereof. Each tubular element is formed by coupling a pair of plate-shaped formed plates 5 and 5 in a face-to-face manner. In the intermediate portion of the tubular element 2, two refrigerant passages 3*a* and 3*b* extending in the direction of height of the core 1 are formed in parallel with each other, wherein one of the refrigerant passages 3*b* is located at the front side of the core 1 and the other 3*a* at the rear side of the core 1. At the upper and lower end portions of the tubular element 2, tank portions 4*a* and 4*b* communicating with the corresponding refrigerant passage 3*a* and 3*b*, respectively, are formed.

Furthermore, in the evaporator, the adjacent tubular elements 2 are communicated with each other via the predetermined tank portions 4*a* and 4*b*, whereby a first pass P1, a second pass P2, a third pass P3 and a fourth pass P4 are formed at the rear left portion, the rear right portion, the front right portion and the front left portion of the core 1, respectively. Between the second pass P2 and the third pass P3, the upper tank portions 4*a* and 4*b* of each tubular element 2 are communicated with each other to form a turn portion T.

The refrigerant flowed into the upper tank portions 4*a* of the first pass P1 flows downward through the first pass P1 to reach the lower tank portions 4*a*. Then, the refrigerant is introduced into the lower tank portions 4*a* of the second pass P2, and then flows upward through the second pass P2 to reach the upper tank portions 4*a*. Thereafter, the refrigerant is introduced into the upper tank portion 4*b* of the third pass P3 through the turn portion T between the second pass P2 and the third pass P3. Subsequently, the refrigerant flows downward through the third pass P3 to reach the lower tank portion 4*b* of the third pass P3, and then is introduced into the lower tank portion 4*b* of the fourth pass P4. Then, the refrigerant flows upward through the fourth pass P4, and flows out of the evaporator via the upper tank portions 4*b*.

In the meantime, while passing through each pass P1 to P4, the refrigerant exchanges heat with the air passing through the core 1 from the front side thereof toward the rear side to be evaporated by absorbing heat from the air.

In the aforementioned conventional evaporator, as shown in FIGS. 24 and 25, when the refrigerant is introduced into the lower tank portions 4*a* of the second pass P2 from the lower tank portions 4*a* of the first pass P1, the refrigerant flows through the lower tank portions 4*a* of the second pass P2 toward the other side (i.e., in the right direction R shown in FIG. 24). As a result, the refrigerant tends to pass through the right side region of the second pass P2 as shown by the oblique lines in FIG. 25 because of the fluidity and/or the inertia of the refrigerant. Then, the biased refrigerant is introduced into the turn portion T between the second pass P2 and the third pass P3 it: to reach the third pass P3. In the third pass P3, the biased state of the refrigerant flow further increases. This prevents an efficient heat exchanging at the entire area of the third pass P3, resulting in deterioration of the cooling performance.

SUMMARY OF THE INVENTION

In view of the above backgrounds, it is an object of the present invention to provide a laminate-type heat exchanger which can prevent a biased refrigerant flow and enhance the cooling performance.

To achieve the aforementioned object, a laminate-type heat exchanger according to the present invention includes a core formed by a plurality of plate-shaped tubular elements laminated in a thickness direction thereof, wherein a laminate direction of the plurality of tubular elements is defined as a width direction of the core, one side of the core in the laminating direction is defined as a first side, and the other side thereof is defined as a second side. Each of the plurality of plate-shaped tubular elements is provided with at least two refrigerant passages extending in a longitudinal direction thereof, the at least two refrigerant passages are arranged in a fore and aft direction of the core. The core includes a plurality of passes, a turn portion and a refrigerant flow resisting portion. Each of the plurality of passes is formed by a prescribed number of the refrigerant passages arranged in the width direction of the core. The turn portion is formed by one longitudinal end portions of the tubular elements constituting a prescribed pass among the plurality of passes and located between the prescribed pass and an adjacent pass facing to the prescribed pass in the fore and aft direction of the core to introduce a refrigerant flowed through the prescribed pass into the adjacent pass. The refrigerant flow resisting portion is provided at the turn portion to restrict a refrigerant flow in the turn portion.

With this laminate-type heat exchanger according to the present invention, since the refrigerant flow resisting portion is provided at the turn portion, the refrigerant passes through the turn portion in an equally distributed manner, and then the equally distributed refrigerant is introduced into the subsequent pass. Therefore, the refrigerant passes through the entire region of the pass in an equally distributed manner, which enhances heat exchanging ability and cooling ability of the heat exchanger.

In a conventional laminate-type heat exchanger, a refrigerant flowed from one side end of a prescribed pass tends to flow through the other side of the prescribed pass in a biased manner and then flows through a turn portion in the biased manner. Therefore, in the present invention, it is preferable that the prescribed pass includes a refrigerant inlet portion for introducing a refrigerant therein so as to be located at the one side of the prescribed pass on the first side of the core, and that the refrigerant flow resisting portion is provided at a side portion of the turn portion on the second side of the core. In this case, since the refrigerant flow resisting portion is provided at a side portion of the turn portion on the second side of the core, the refrigerant flow at the side portion of the turn portion is restricted by the refrigerant flow resisting portion, which causes a refrigerant flow at the other side portion of the turn portion. As a result, the refrigerant can be distributed assuredly and equally in the turn portion, which improves the heat exchanging efficiency of the heat exchanger.

Furthermore, in the present invention, it is preferable to employ the following structural features in order to easily realize the aforementioned refrigerant flow resisting portion.

A part of the turn portion constitutes a restricting pass which restricts a refrigerant flow, and the remaining part of the turn portion constitutes a free pass which does not restrict a refrigerant flow, and wherein the restricting pass constitutes the refrigerant flow restricting portion.

Furthermore, the restricting pass includes a semi-restricting passage which partially restricts a refrigerant flow and/or an interrupting passage which interrupts a refrigerant flow.

Furthermore, the semi-restricting passage has one half a cross-sectional area of the free passage.

Furthermore, a passage of the turn portion located at a side of the prescribed pass on the first side of the core constitutes the free pass.

Furthermore, each of the plurality of tubular elements is provided with two refrigerant passages, wherein the refrigerant passages of the tubular elements forming one half of the core on the first side of the core form a first pass and a fourth pass, wherein the refrigerant passages of the tubular elements forming the other half of the core on the second side of the core form a second pass and a third pass, and wherein the turn portion is disposed between the second pass and the third pass. As mentioned above, the present invention can be preferably adopted to a laminate-type heat exchanger in which two refrigerant passages are arranged fore and aft.

In the present invention applied to this kind of laminate-type heat exchanger, it is preferable to adopt the following structural features in order to improve the heat exchanging efficiency by more equally distributing the refrigerant.

The refrigerant flow restricting portion is provided at a part of the turn portion on the second side of the core.

A part of the turn portion constitutes a restricting pass which restricts a refrigerant flow, and the remaining part of the turn portion constitutes a free pass which does not restrict a refrigerant flow, wherein the restricting pass constitutes the refrigerant flow restricting portion, and wherein the restricting pass is constituted by a first tubular element from a second side of the turn portion on the second side of the core.

Furthermore, a part of the turn portion on the first side of the core constitutes the free pass.

Furthermore, each of first, fourth and fifth tubular elements forming the turn portion from a second side thereof on the second side of the core is provided with the refrigerant flow restricting portion.

Furthermore, each of the tubular elements constituting the turn portion is provided with the refrigerant flow restricting portion.

Furthermore, a first tubular element forming the turn portion from a second side thereof on the second side of the core is provided with the refrigerant flow restricting portion.

Furthermore, each of the first, second and third tubular elements from a second side thereof on the second side of the core is provided with the refrigerant flow restricting portion.

BRIEF DESCRIPTION OF THE DRAWINGS

The present invention will be more fully described and better understood from the following description, taken with the appended drawings, in which:

FIG. 8A is a perspective view showing a second tubular element of the evaporator of the first embodiment in a disassembled state;

FIG. 8B is a perspective view showing a second tubular element of the evaporator of the first embodiment in an assembled state;

FIG. 9 is a horizontal cross-sectional view of the upper tank portions of the second tubular element of the evaporator of the first embodiment;

FIG. 10A is a perspective view showing a third tubular element of the evaporator of the first embodiment in a disassembled state;

FIG. 10B is a perspective view showing the third tubular element of the evaporator of the first embodiment in an assembled state;

FIG. 11 is a horizontal cross-sectional view of the upper tank portions of the third tubular element of the evaporator of the first embodiment;

DETAILED DESCRIPTION OF THE PREFERRED EMBODIMENT

Figure 1:
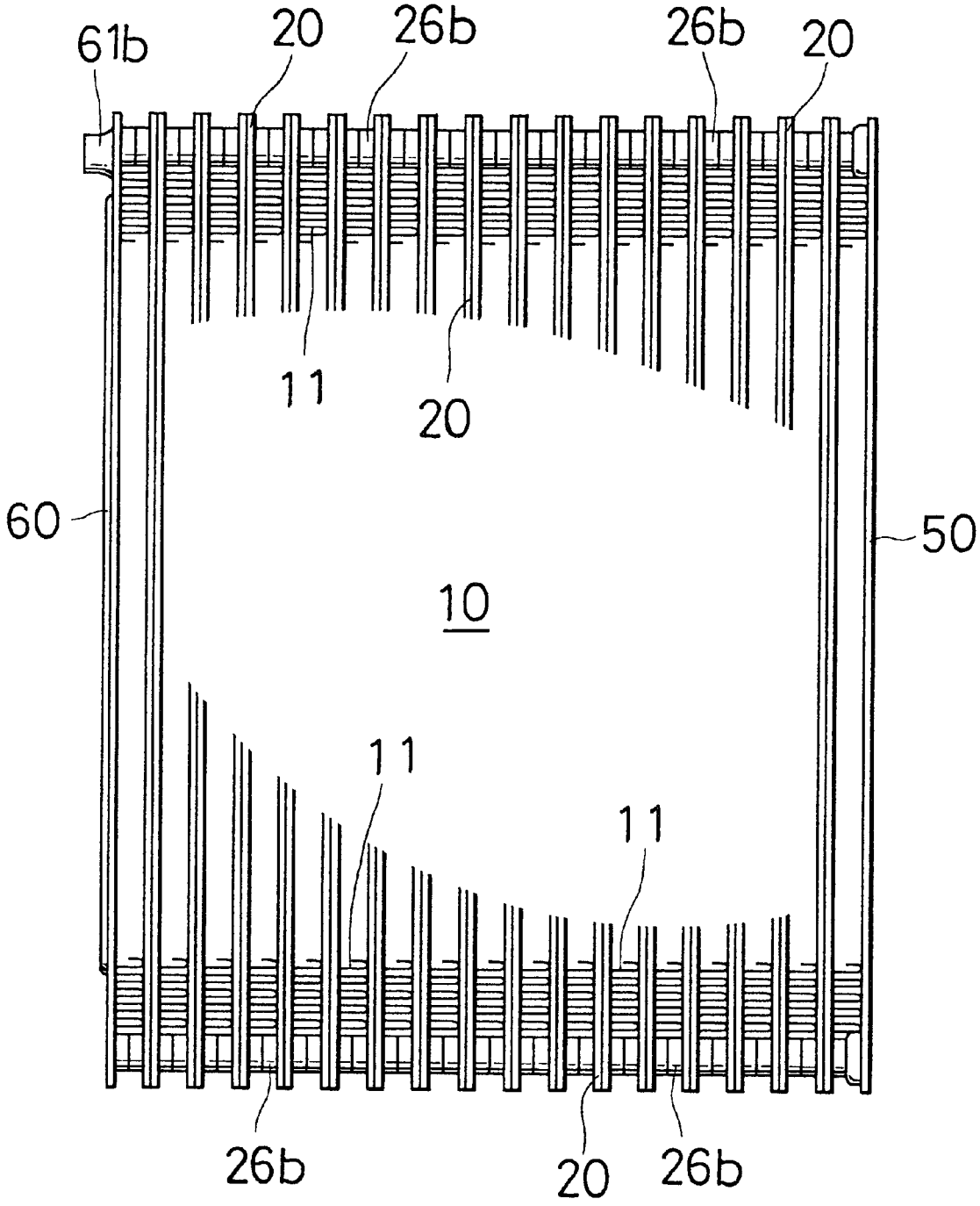
FIG. 1 is a front view of an evaporator as a laminate-type heat exchanger according to a first embodiment of the present invention.

FIGS. 1 to 5 show an evaporator for use in an automobile air conditioning system as a laminate-type heat exchanger according to the present invention.

As shown in these figures, this evaporator has a first pass P1, a second pass P2, a third pass P3 and a fourth pass P4. Between the upper portions of the second and third passes P2 and P3, a turn portion T is provided. A refrigerant flows downward through the first pass P1, and then flows upward through the second pass P2. Then, the refrigerant is introduced into the third pass P3 via the turn portion T. Thereafter, the refrigerant flows downward through the third pass P3, and then flows upward through the fourth pass P4.

The evaporator has a core 10 including a plurality of plate-shaped tubular elements 20 and a plurality of outer fins 11 made of corrugated fins. The tubular elements 20 are laminated in the thickness direction thereof (in the right and left direction in FIG. 1) with the outer fin 11 interposed therebetween.

At one side end (right side end in FIG. 1) of the laminated tubular elements 20, a side plate 50 is disposed via the outer fin 11. At the other side end (left side end in FIG. 1) of the laminated tubular elements 20, an end plate 60 is disposed via the outer fin 11.

As shown in FIGS. 6 to 11, each tubular element 20 is formed by coupling a pair of plate-shaped formed plates 31 and 32, each made of an aluminum brazing sheet, in a face-to-face manner.

Figure 2:
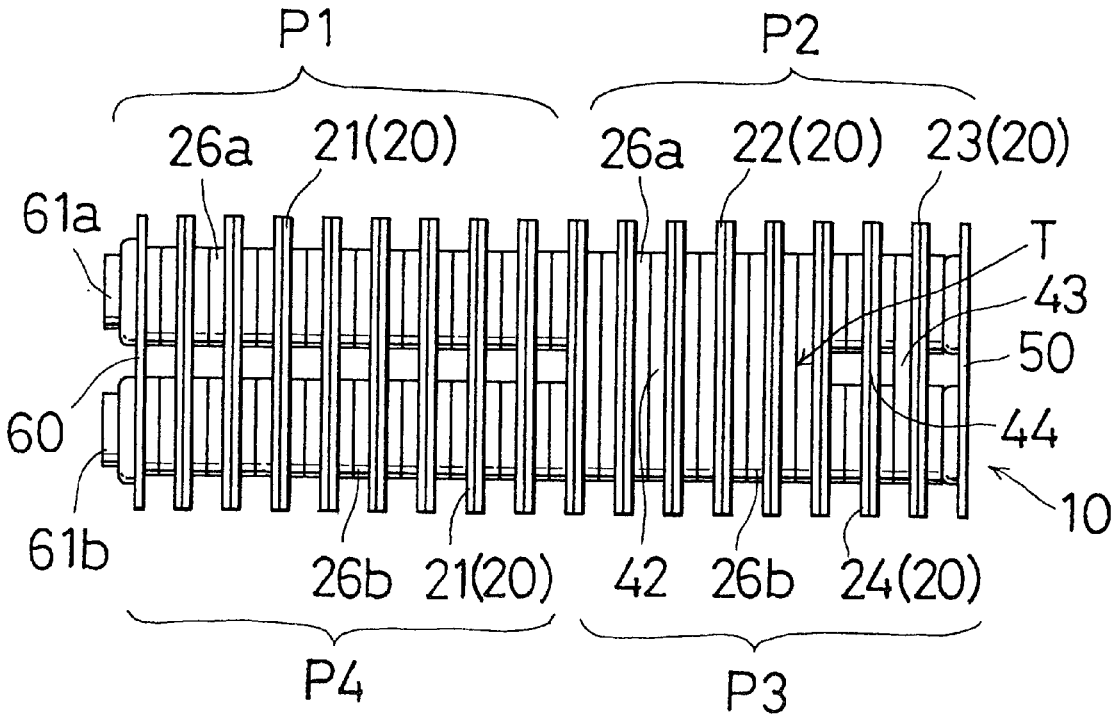
FIG. 2 is a top view of the evaporator of the first embodiment.

As shown in FIG. 2, the tubular elements 20 include a plurality of first tubular elements 21 constituting the left half of the core 10, or the first and fourth passes P1 and P4, and a plurality of second to fourth tubular elements 22, 23 and 24 constituting the right half of the core 10, or the second and third passes P2 and P3.

Figure 6A:
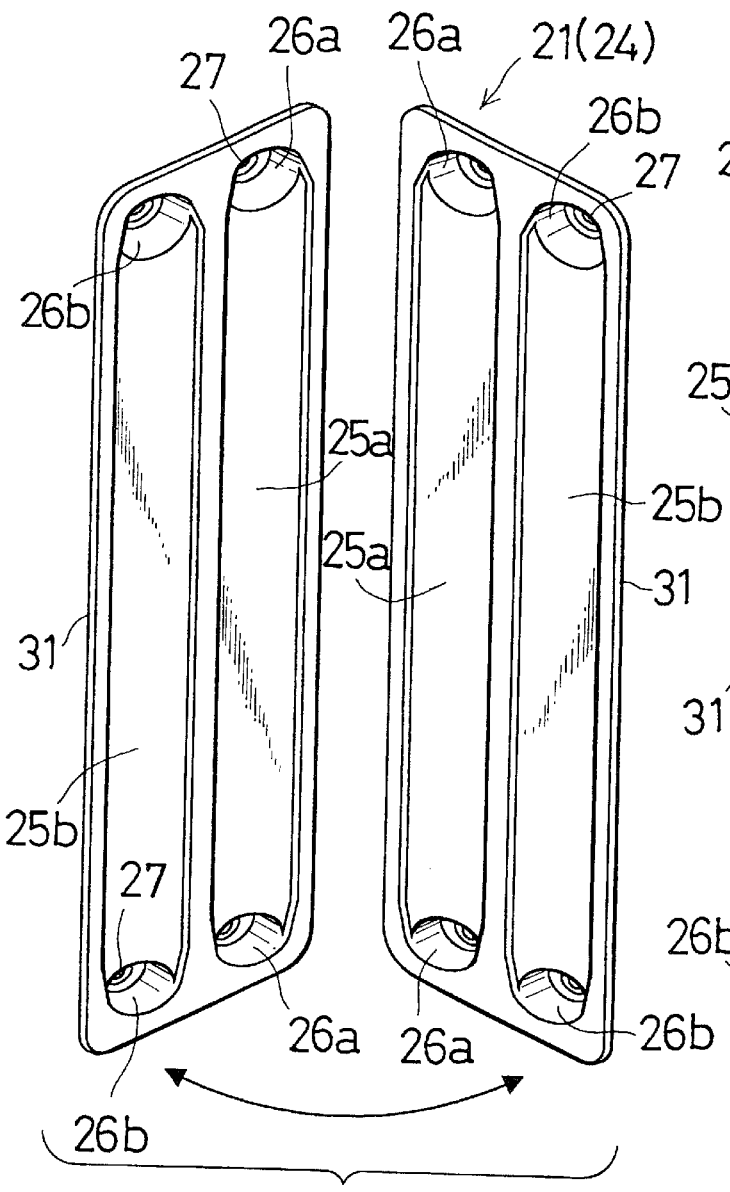
FIG. 6A is a perspective view showing a first (fourth) tubular element of the evaporator of the first embodiment in a disassembled state.
Figure 6B:
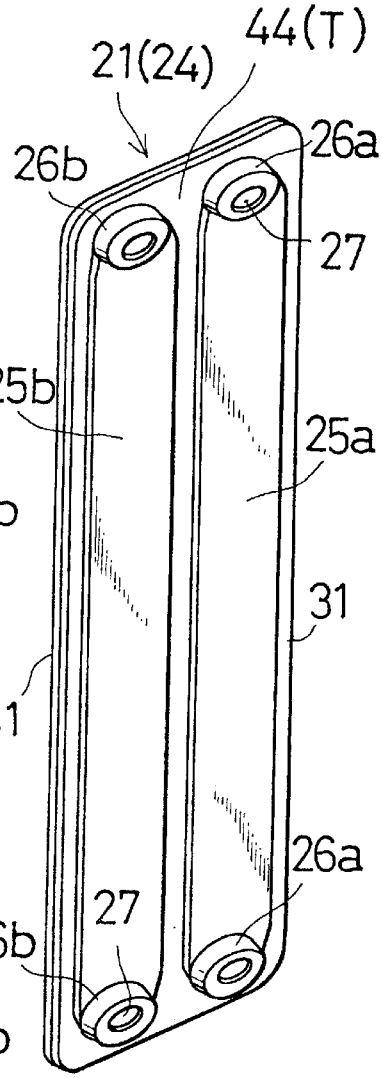
FIG. 6B is a perspective view showing a first (fourth) tubular element of the evaporator of the first embodiment in an assembled state.
Figure 7:
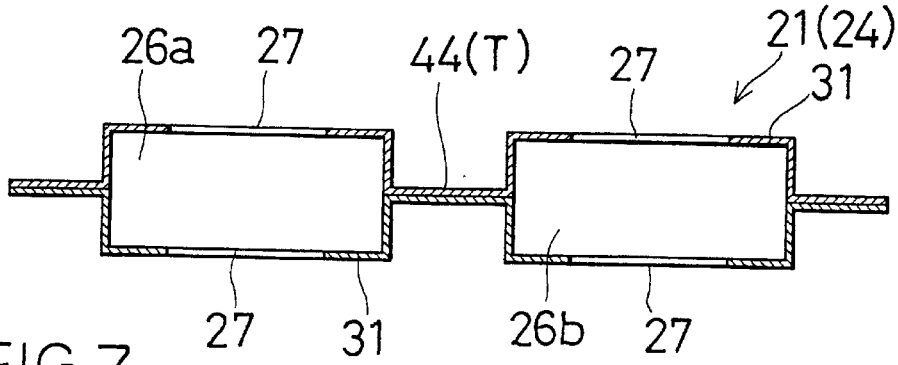
FIG. 7 is a horizontal cross-sectional view of the upper tank portions of the first (fourth) tubular element of the evaporator of the first embodiment.

As shown in FIGS. 6 and 7, a plate-shaped formed plate 31 constituting the first tubular element 21 has, at its intermediate region of the inner surface portion except for the longitudinal end portions, two refrigerant passage forming dented portions 25*a* and 25*b* which extend in the longitudinal direction of the tubular element 21 and are disposed in parallel to each other in the width direction of the formed plate 31. Furthermore, the plate-shaped formed plate 31 has, at its longitudinal end portions, tank portion forming dented portions 26*a* and 26*b* which are communicated with the aforementioned corresponding refrigerant passage forming dented portions 25*a* and 25*b*. As will be mentioned later, except for some plate-shaped formed plates, communication apertures 27 and 27 are formed at 5 the bottom wall of the tank portion forming dented portions 26*a* and 26*b*.

The aforementioned pair of plate-shaped formed plates 31 and 31 are coupled in a face-to-face manner via an inner fin (not shown) to form the first tubular element 21 which constitutes the left half of the core 10. In the aforementioned tubular element 21, at its internal intermediate region, two refrigerant passages 25*a* and 26*b* extending in the longitudinal direction thereof are formed by coupling the corresponding refrigerant passage forming dented portions 25*a* and 25*b*. Furthermore, at its longitudinal end portions, tank portions 26*a* and 26*b* are formed by coupling the corresponding tank portion forming dented portions 26*a* and 26*b*.

In the explanation of this embodiment, in order to avoid a confusion due to too many reference numerals, the refrigerant passage and the refrigerant passage forming dented portion are allotted by the same reference numeral, and the tank portion and the tank portion forming dented portion are also allotted by the same reference numerals.

As mentioned above, at the left half of the core 10, a total of eight pieces of the aforementioned first tubular elements 21 are laminated in the thickness direction thereof. The corresponding tank portions 26*a* and 26*b* of the adjacent tubular elements 21 are communicated with each other via the communication apertures 27. Furthermore, the rear side refrigerant passages 25*a* of the tubular elements 21 form the aforementioned first pass P1, and the front side refrigerant passages 26*b* of the tubular elements 21 form the aforementioned fourth pass P4.

On the other hand, as the tubular element 20 constituting the second pass P2 and the third pass P3, the aforementioned second to fourth tubular elements 22 to 24 are used.

As shown in FIGS. 8 and 9, each of the second plate-shaped formed plates 32 and 32 has a passage forming dented portion 42*a* communicating both the dented portions 26*a* and 26*b* between the upper tank portion forming dented portions 26*a* and 26*b*. The other structures are the same as the aforementioned first plate-shaped formed plate 31.

The aforementioned second plate-shaped formed plates 32 and 32 are integrally connected via an inner fin (not shown) in a face-to-face manner to form the second tubular element 22. In this tubular element 22, in the same way as the tubular element 21, refrigerant passages 25*a* and 26*b* and the tank portions 26*a* and 26*b* are formed. At the portion corresponding to the turn portion T, a free passage 42 communicating the upper tank portions 26*a* and 26*b* is formed by coupling the passage forming dented portions 42*a* and 42*a*.

As shown in FIGS. 10 and 11, the third tubular element 23 is formed by integrally connecting the aforementioned first plate-shaped formed plate 31 having no passage forming dented portion 42*a* and the aforementioned second plate-shaped formed plate 32 having the passage forming dented portion 42*a* in a face-to-face manner via an inner fin (not shown). In this tubular element 23, in the same way as the tubular element 21, refrigerant passages 25*a* and 26*b* and the tank portions 26*a* and 26*b* are formed. At the portion corresponding to the turn portion T, a semi-restricting passage 43 communicating the upper tank portions 26*a* and 26*b* is formed by the passage forming dented portion 42*a* of the second plate-shaped formed plate 32. The semi-restricting passage 43 has half the passage cross-sectional area of the free passage 42 of the second tubular element 22 and restricts a refrigerant flow.

The fourth tubular element 24 has the same structure as the first tubular element 21 shown in FIGS. 6 and 7. In other words, the upper tank portions 26*a* and 26*b* of the fourth tubular element 24 are not communicated each other, and the portion corresponding to the turn portion T constitutes an interrupting passage 44.

Figure 5:
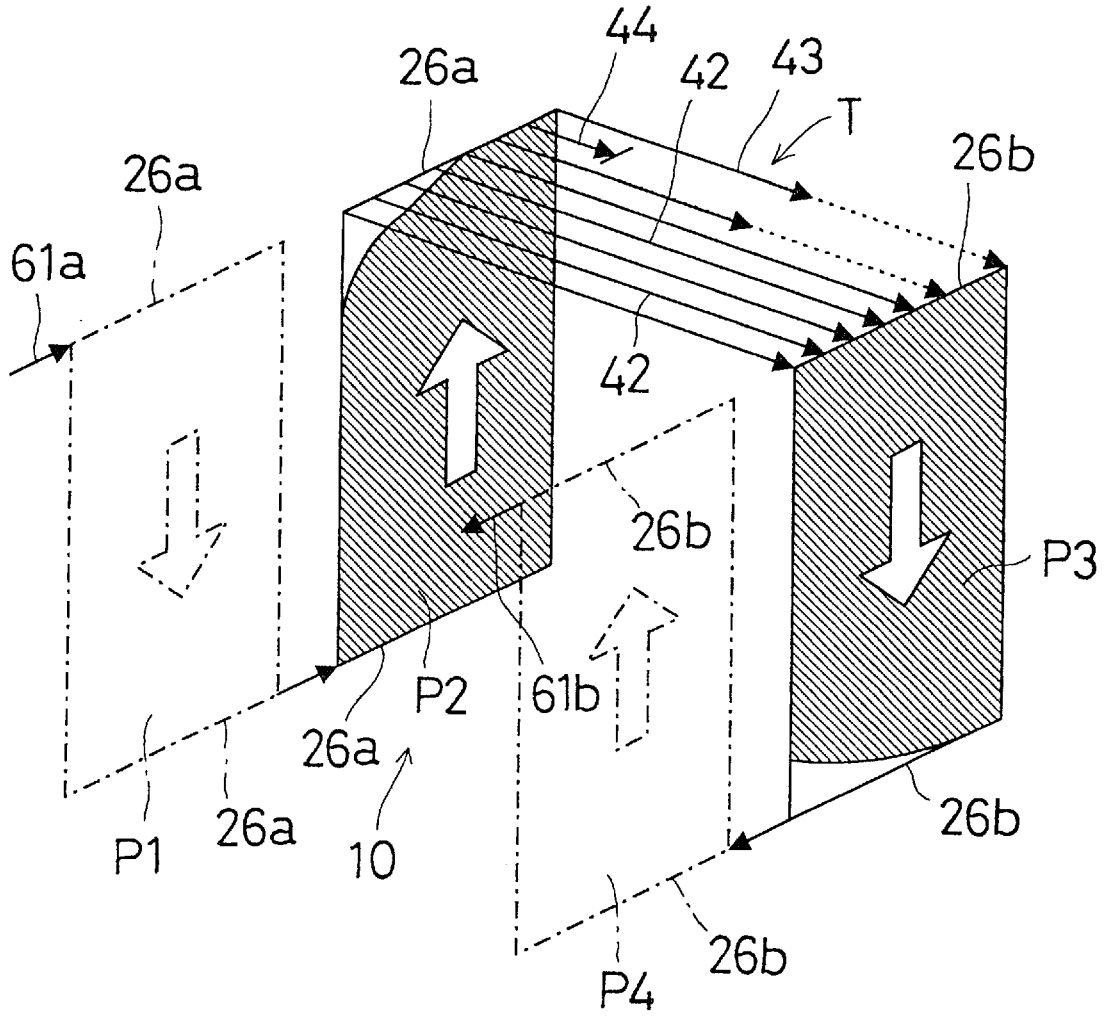
FIG. 5 is a perspective view showing a refrigerant flow in the evaporator of the first embodiment.

In this embodiment, as shown in FIGS. 2 and 5, at the right half side of the core 10, the aforementioned second to fourth tubular elements 22 to 24 are integrally laminated via outer fins 11 such that the third tubular element 23 is positioned at the first position from the right side, the fourth tubular element 24 at the second position, the third tubular element 23 at the third position, the second tubular elements 22 at the fourth to seventh positions and the third tubular element 23 at the eighth position. Thus, in the same way as in the left half side of the core 10, the adjacent tank portions 26*a* and 26*b* are communicated with each other via the communication aperture 27, and the rear side refrigerant passages 25*a* form the second pass P2 and the front side refrigerant passage 26*b* form the third pass P3. At the turn portion T between the second pass P2 and the third pass P3, the portions formed by the second tubular element 22 and the third tubular element 23 are communicated by the free passage 42 and the semi-restricting passage 43, respectively, and the portion formed by the fourth tubular element 24 is not communicated to form the interrupting passage 44. In this embodiment, the interrupting passage 44 and the semi-interrupting passage 43 constitute a restricting pass which constitutes the refrigerant flow restricting portion.

At the left side of the second and third passes P2 and P3, the third tubular element 23 having a semi-restricting passage 43 is disposed. However, this semi-restricting passage 43 is not intended to distribute the refrigerant, and is therefore different from the refrigerant flow restricting portion in the present invention. In other words, in the present invention, at the left side end of the second and third passes P2 and P3 as a part of the turn portion T, the second tubular element 22 having the free passage 42 may be provided.

Figures 12A, 12B:
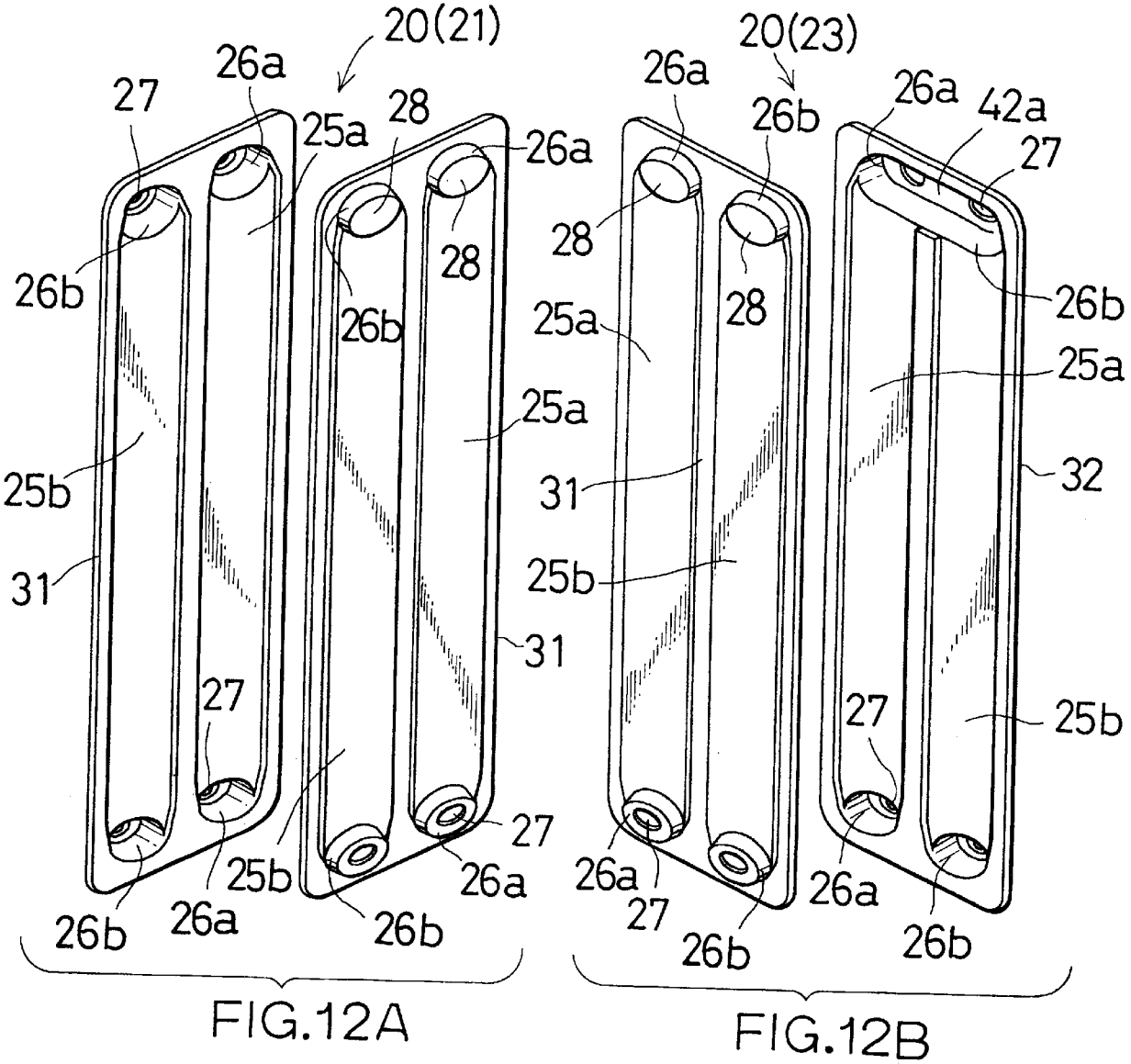
FIG. 12A is an exploded perspective view of a tubular element to be disposed at the side of a first (fourth) pass.
FIG. 12B is an exploded perspective view of a tubular element to be disposed at the side of a second (third) pass.

As shown in FIG. 12A, among the plate-shaped formed plates 31 constituting the first and fourth passes P1 and P4 at the left half of the core 10, the plate-shaped formed plate 31 disposed at the right most end has upper tank forming dented portions 26*a* and 26*b* each having a bottom wall with no communicating aperture as a closed portion 28. Furthermore, among the plate-shaped formed plates 31 and 32 constituting the second and third passes P2 and P3 at the right half of the core 10, the plate-shaped formed plate 31 disposed at the left most end has upper tank forming dented portions 26*a* and 26*b* each having a bottom wall with no communicating aperture as a closed portion 28. Thus, between the first and second passes P1 and P2 and between the third and fourth passes P3 and P4, the upper tank portions 26*a* and 26*b* are not communicated with each other.

Furthermore, in this embodiment, between the first and if second passes P1 and P2, the lower tank portions 26*a* and 26*a* are communicated with each other via the communication aperture 27. The communication aperture 27 constitutes a refrigerant inlet portion for introducing a refrigerant into the second pass P2, i.e., a prescribed pass.

Figure 3A:
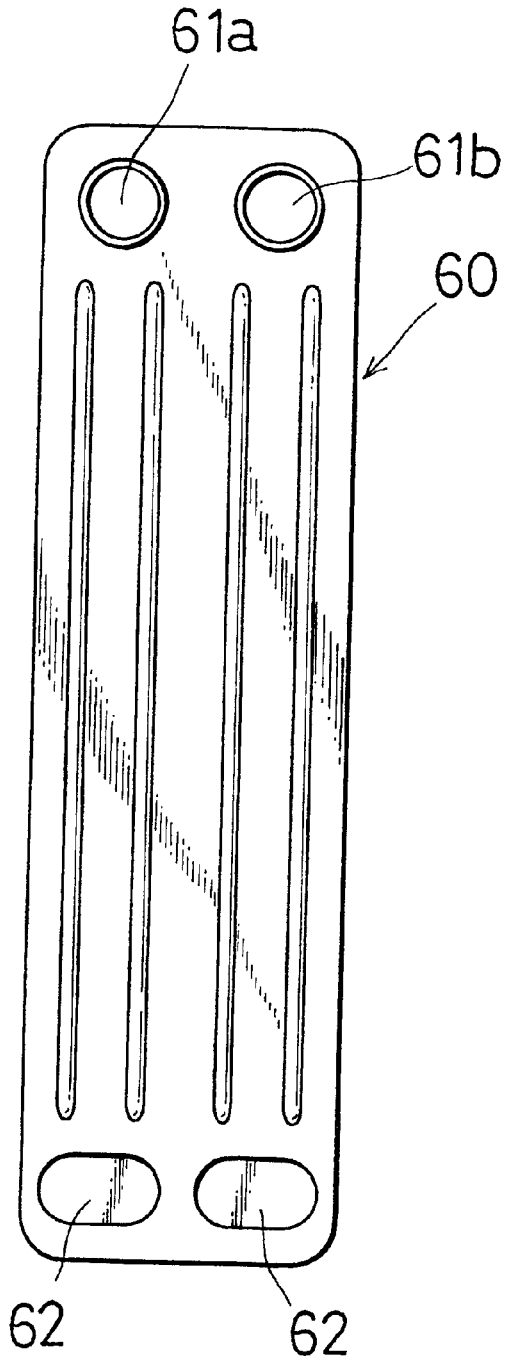
FIG. 3A is a front view showing an end plate of the evaporator of the first embodiment.

As shown in FIG. 3A, the end plate 60 laminated at the left most end of the core 10 is provided with a refrigerant inlet 61*a* and a refrigerant outlet 61*b* communicating with the communication aperture 27 and 27 of the upper tank portions 26*a* and 26*b* of the tubular element 20 and a closing portion 62 and 62 for closing the communication apertures 27 and 27 of the lower tank portions 26*a* and 26*b* of the tubular element 20.

Figure 3B:
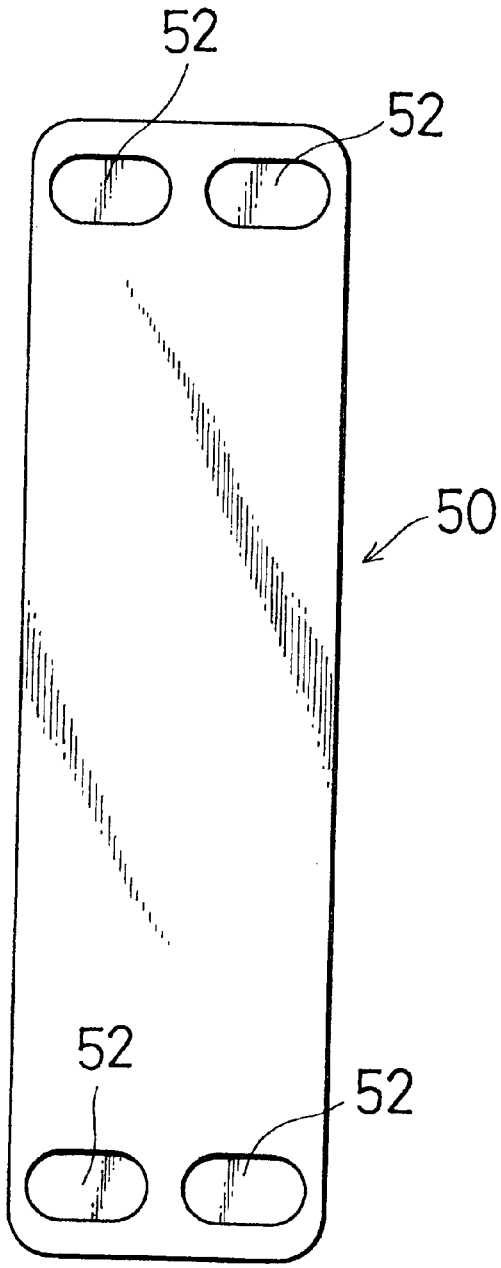
FIG. 3B is a front view showing a side plate of the evaporator of the first embodiment.
Figure 4:
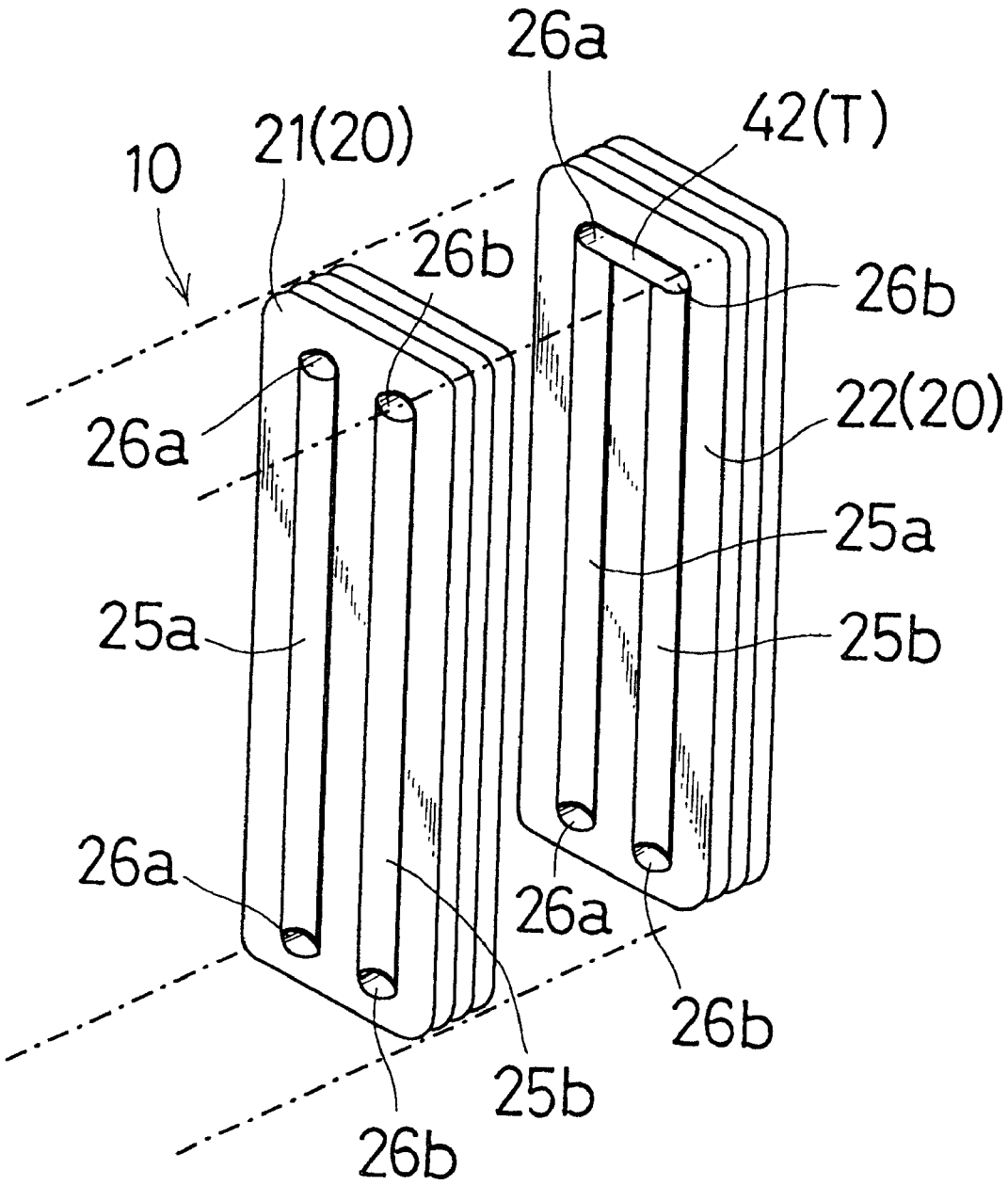
FIG. 4 is a schematic perspective view of a core of the evaporator of the first embodiment.

As shown in FIG. 3B, the side plate 50 laminated at the right most end of the core 10 is provided with closing portions 52 for closing the communication apertures 27 and 27 of the upper and lower tank portions 26*a* and 26*b* of the tubular element 20.

In the aforementioned evaporator, a refrigerant flowed though the refrigerant inlet 61*a* of the end plate 60 is introduced into the upper tank portions 26*a* of the first pass P1, and then flows downward through the refrigerant passages 25*a* of the first pass P1 to reach the lower tank portions 26*a*. Then, the refrigerant is introduced into the lower tank portions 26*a* of the second pass P2, and then flows upward through the refrigerant passages 25*a* of the second pass P2 to reach the upper tank portions 26*a*. Thereafter, the refrigerant is introduced into the upper tank portion 26*b* of the third pass P3 through the free passages 42 and the semi-restricting passages 43 of the turn portion T. Subsequently, the refrigerant flows downward through the refrigerant passages 26*b* of the third pass P3 to reach the lower tank portion 26*b* of the third pass P3, and then is introduced into the lower tank portion 26*b* of the fourth pass P4. Then, the refrigerant flows upward through the refrigerant passages 26*b* of the fourth pass P4 to reach the upper tank portion 26*b*, and flows out of the refrigerant outlet 61*b* of the end plate 60.

When the refrigerant is flowing through the evaporator, the refrigerant passing through the turn portion T between the second pass P2 and the third pass P3 tends to flow the right side of the turn portion T due to the fluidity and/or the inertia of the refrigerant. However, in the present embodiment, since the interrupting passage 44 and the semi-restricting passage 43 are disposed at the right side of the turn portion T, the refrigerant flow is restricted at the right side of the turn portion T. Therefore, the refrigerant is distributed to the left side of the turn portion T. As a result, the refrigerant passes through the turn portion T in an equally distributed manner, and then is introduced into the third pass P3. Therefore, the refrigerant passes through the refrigerant passages 26*b* of the third pass P3 in an equally distributed manner. This results in an enhanced heat exchanging and improved cooling performance.

In the present invention, it is not required to use the evaporator in a state that the tubular elements are disposed vertically. The evaporator may be used in any desired position. For example, the evaporator may be used in a state that the fit tubular elements are declined.

Furthermore, the present invention can also be applied to an evaporator having a turn portion provided at the lower ends of adjacent passes arranged fore and aft.

Furthermore, the number of passes and/or the structure of each pass are not limited to the aforementioned embodiment. The present invention can also be applied to an evaporator including tubular elements each having three or more refrigerant passages arranged fore and aft, i.e., including three or more passes arranged fore and aft.

Next, inventive examples according to the present invention and a comparative example will be explained.

INVENTIVE EXAMPLE NO. 1

Figure 13:
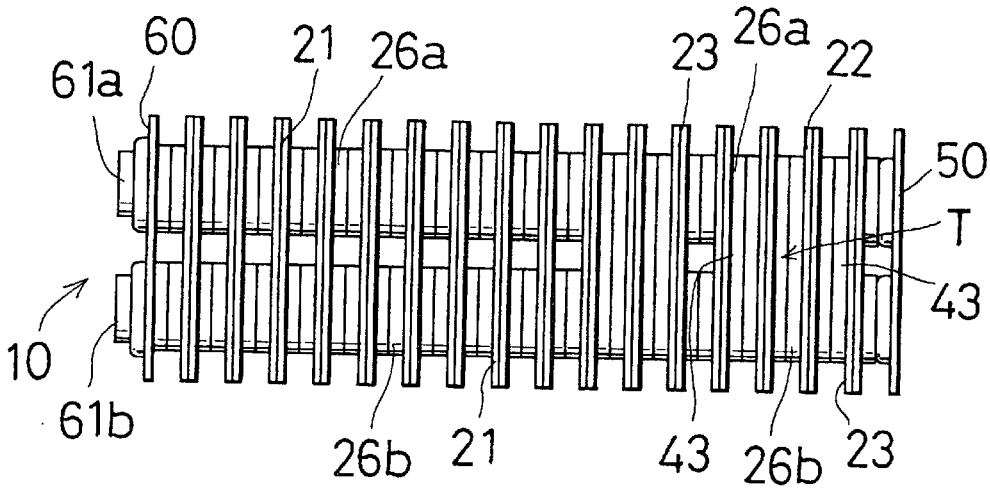
FIG. 13 is a top view of the evaporator of a first inventive example.
Figure 14:
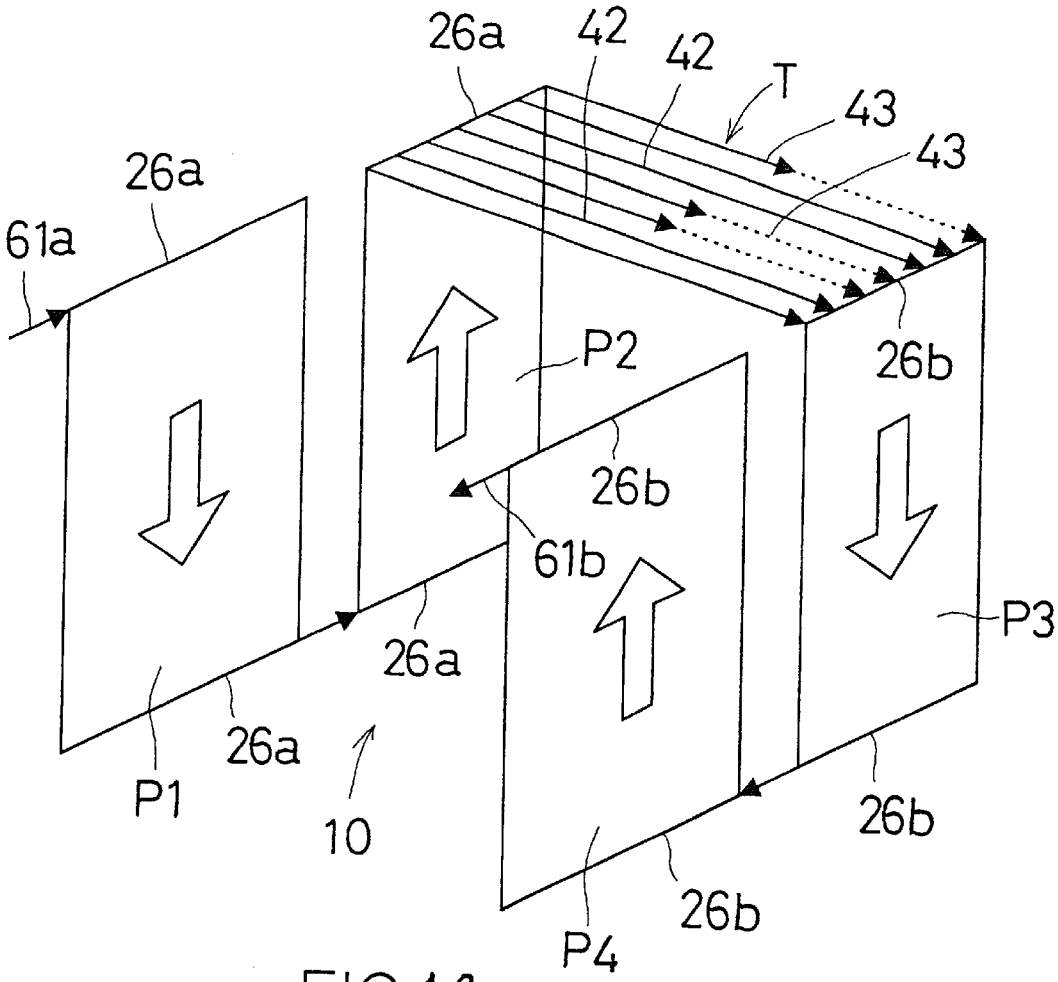
FIG. 14 is a perspective view showing a refrigerant flow in the evaporator of the first inventive example.

As shown in FIGS. 13 and 14, an evaporator formed by laminating sixteen (16) tubular elements was prepared. In this evaporator, the first pass P1 and the fourth pass P4 are formed by laminating nine (9) pieces of the aforementioned first tubular elements 21, and the second pass P2 and the third pass P3 are formed by laminating seven (7) pieces of the aforementioned second and third tubular elements 22 and 23. In detail, at the first, fourth, fifth and seventh position from the right side, the aforementioned third tubular elements 23 each having a semi-restricting passage at the turn portion T are disposed. At the second, third and sixth position from the right side, the aforementioned second tubular elements 22 each having a free passage at the turn portion T are disposed.

In the example, although the tubular element 23 having a semi-restricting passage 43 at the turn portion T is disposed at the left end of the second and third passes P2 and P3, the semi-restricting passage 43 is not used to distribute the refrigerant and is therefore different from the refrigerant flow restricting portion according to the present invention (the same interpretation is also applied to the following inventive examples Nos. 2 to 4 as well as a comparative example).

INVENTIVE EXAMPLE NO. 2

Figure 15:
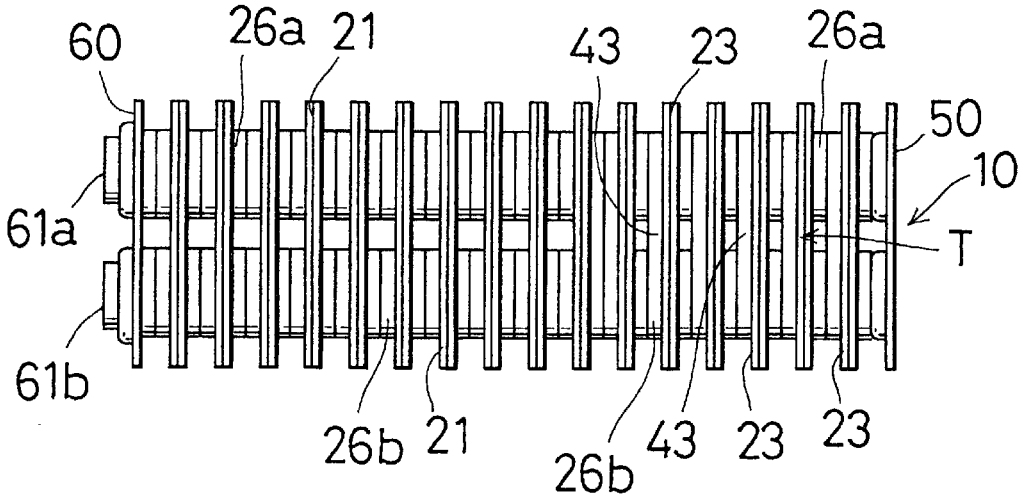
FIG. 15 is a top view of the evaporator of a second inventive example.
Figure 16:
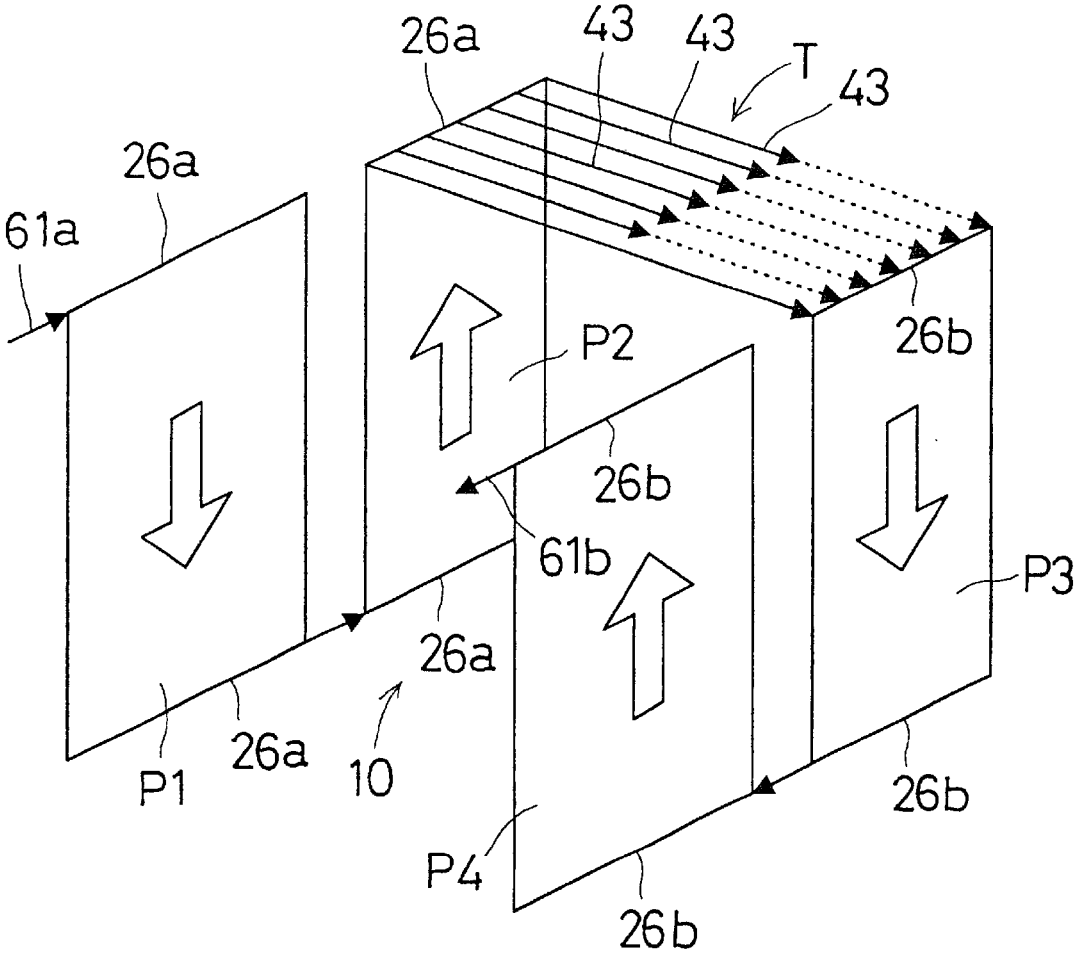
FIG. 16 is a perspective view showing a refrigerant flow in the evaporator of the second inventive example.

As shown in FIGS. 15 and 16, an evaporator formed by laminating sixteen (16) tubular elements was prepared. In this evaporator, the first pass P1 and the fourth pass P4 are formed by laminating nine (9) pieces of the aforementioned first tubular elements 21, and the second pass P2 and the third pass P3 are formed by laminating seven (7) pieces of the aforementioned third tubular elements 23 each having a semi-restricting passage 43.

INVENTIVE EXAMPLE NO. 3

Figure 17:
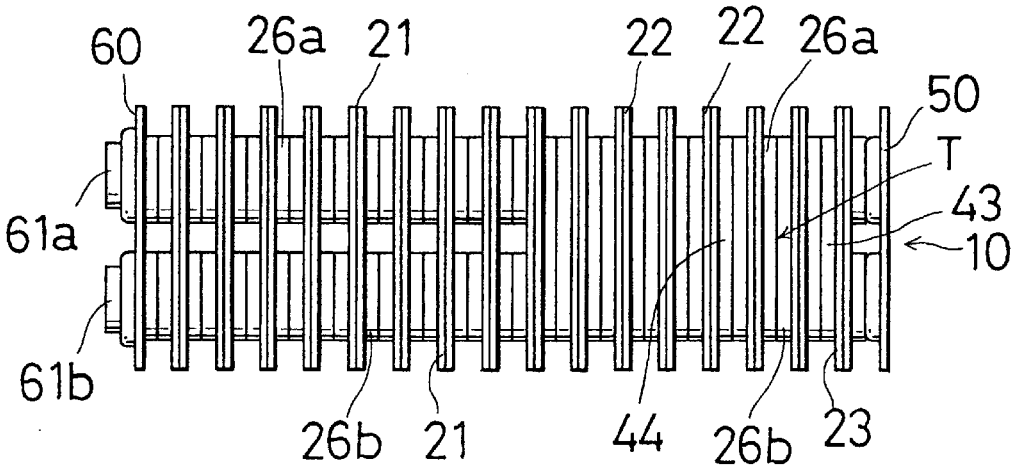
FIG. 17 is a top view of the evaporator of a third inventive example.
Figure 18:
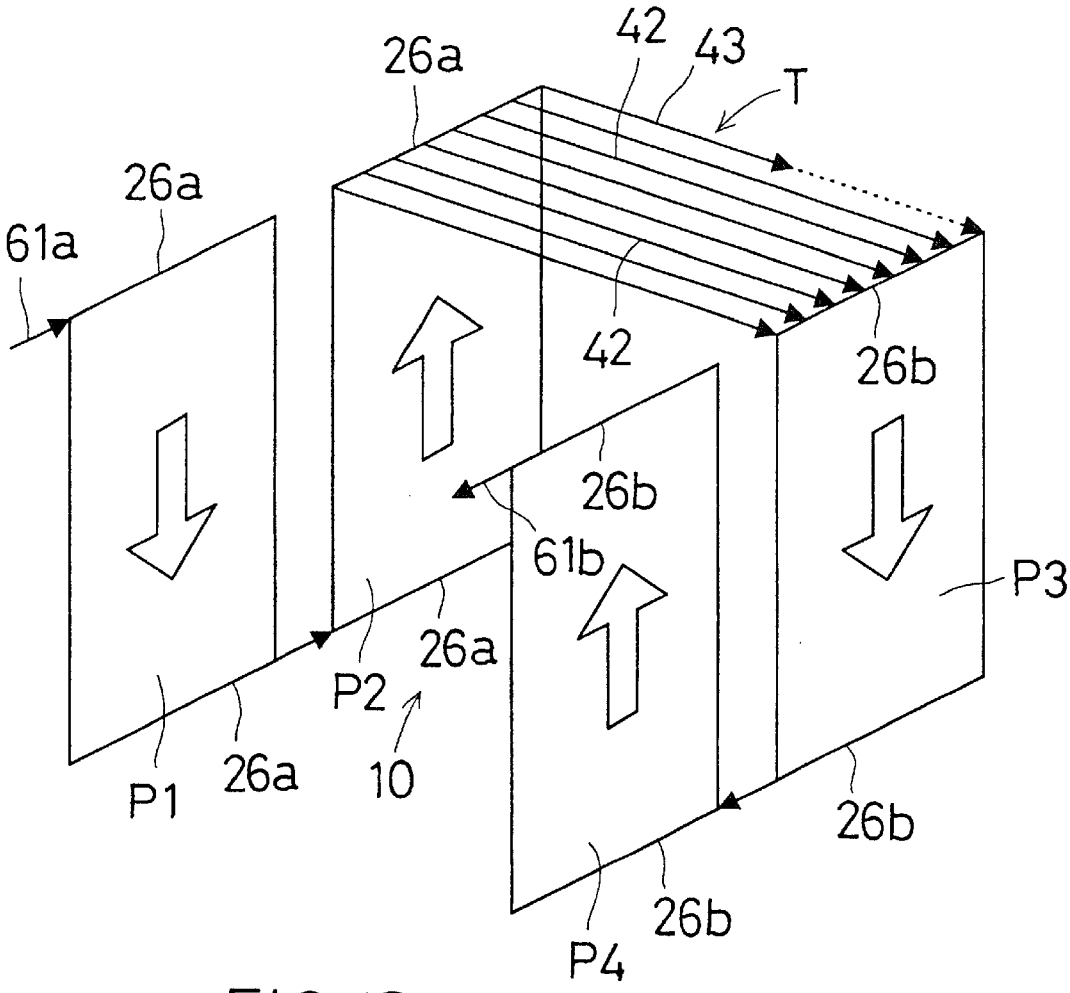
FIG. 18 is a perspective view showing a refrigerant flow in the evaporator of the third inventive example.

As shown in FIGS. 17 and 18, an evaporator formed by laminating sixteen (16) tubular elements was prepared. In this evaporator, the first pass P1 and the fourth pass P4 are formed by laminating eight (8) pieces of the aforementioned first tubular elements 21, and the second pass P2 and the third pass P3 are formed by laminating eight (8) pieces of the aforementioned second and third tubular elements 22 and 23. In detail, at the first and eight positions of the second pass P2 and the third pass P3 from the right side, the aforementioned third tubular elements 23 each having a semi-restricting passage 43 at the turn portion T are disposed. At the remaining positions, the aforementioned second tubular elements 22 each having a free passage 42 at the turn portion T are disposed.

INVENTIVE EXAMPLE NO. 4

Figure 19:
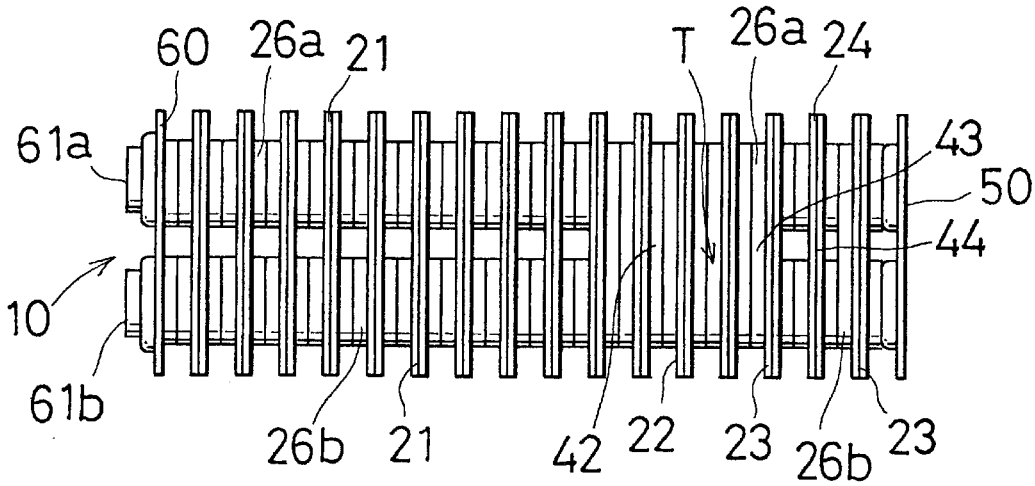
FIG. 19 is a top view of the evaporator of a fourth inventive example.
Figure 20:
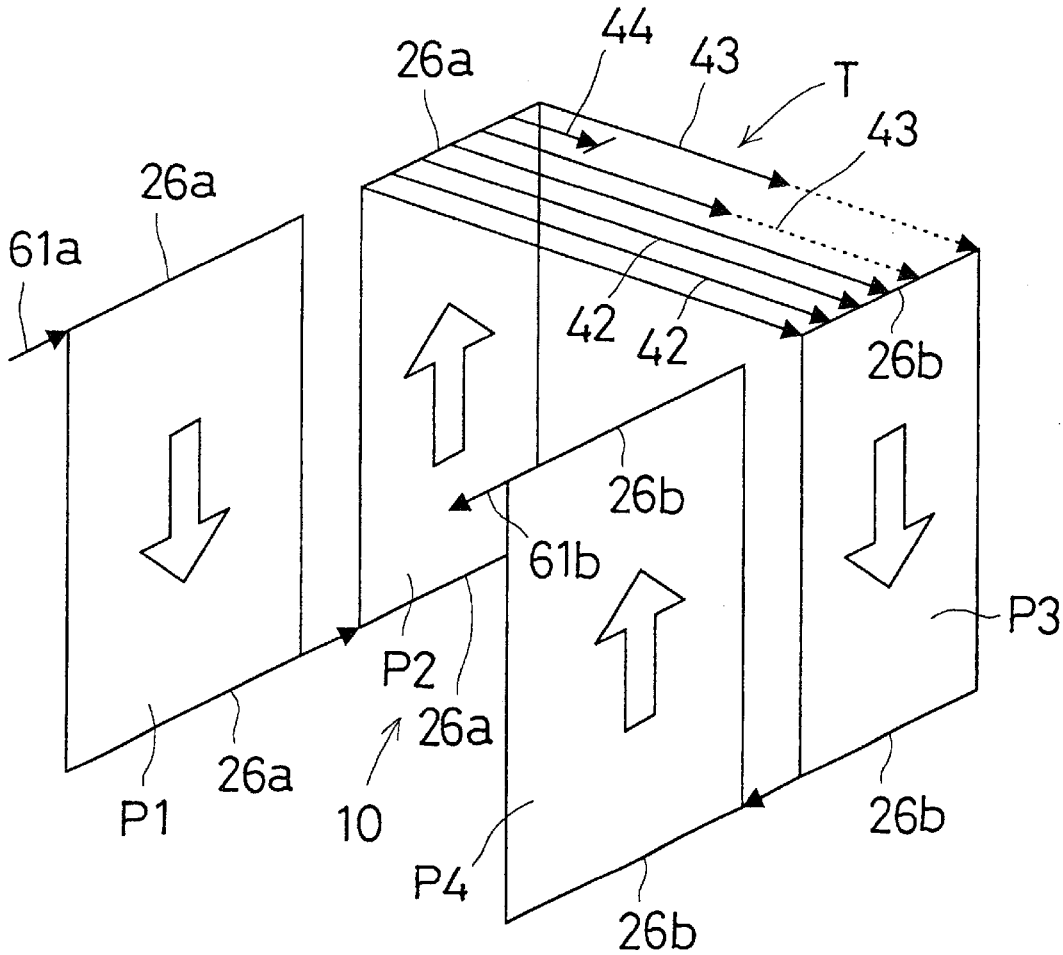
FIG. 20 is a perspective view showing a refrigerant flow in the evaporator of the fourth inventive example.

As shown in FIGS. 19 and 20, an evaporator formed by laminating sixteen (16) tubular elements was prepared. In this evaporator, the first pass P1 and the fourth pass P4 are formed by laminating nine (9) pieces of the aforementioned first tubular elements 21, and the second pass P2 and the third pass P3 are formed by laminating seven (7) pieces of the aforementioned second to fourth tubular elements 22 to 24. In detail, at the first, third and seventh positions of the second pass P2 and the third pass P3 from the right side, the aforementioned third tubular elements 23 each having a semi-restricting passage 43 at the turn portion T are disposed. At the second position, the aforementioned fourth tubular element 24 having an interrupting passage at the turn portion T is disposed. At the remaining positions, the aforementioned second tubular elements 22 each having a free passage 42 at the turn portion T are disposed.

COMPARATIVE EXAMPLE

Figure 21:
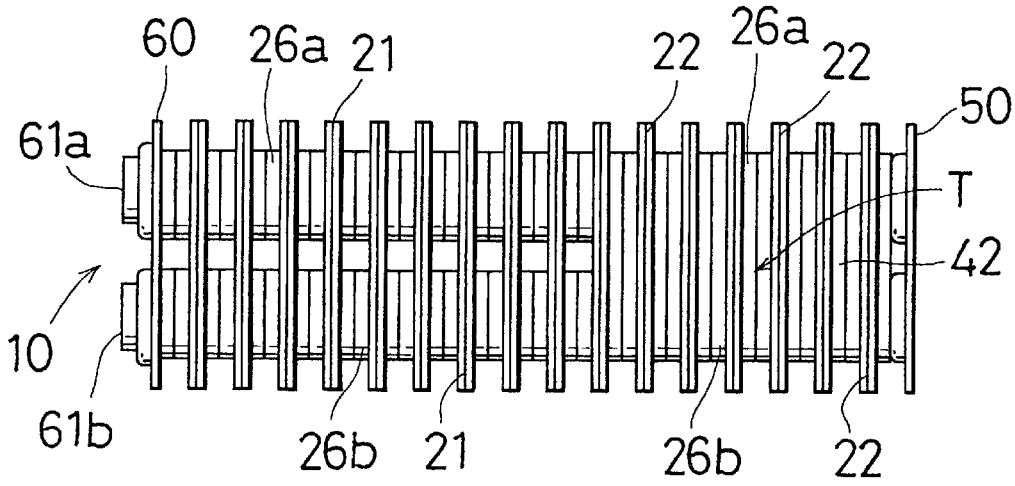
FIG. 21 is a top view of an evaporator of a comparative example.
Figure 22:
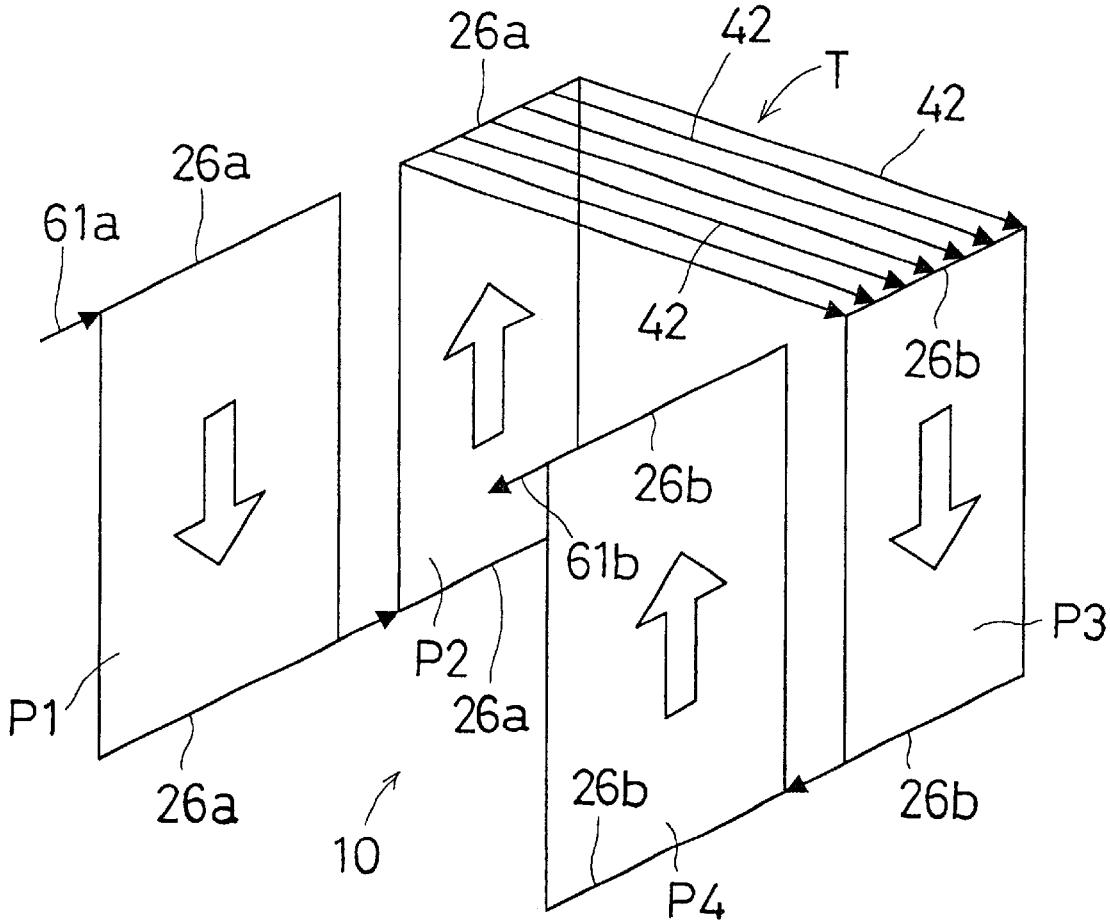
FIG. 22 is a perspective view showing a refrigerant flow in the evaporator of the comparative example.
Figure 23:
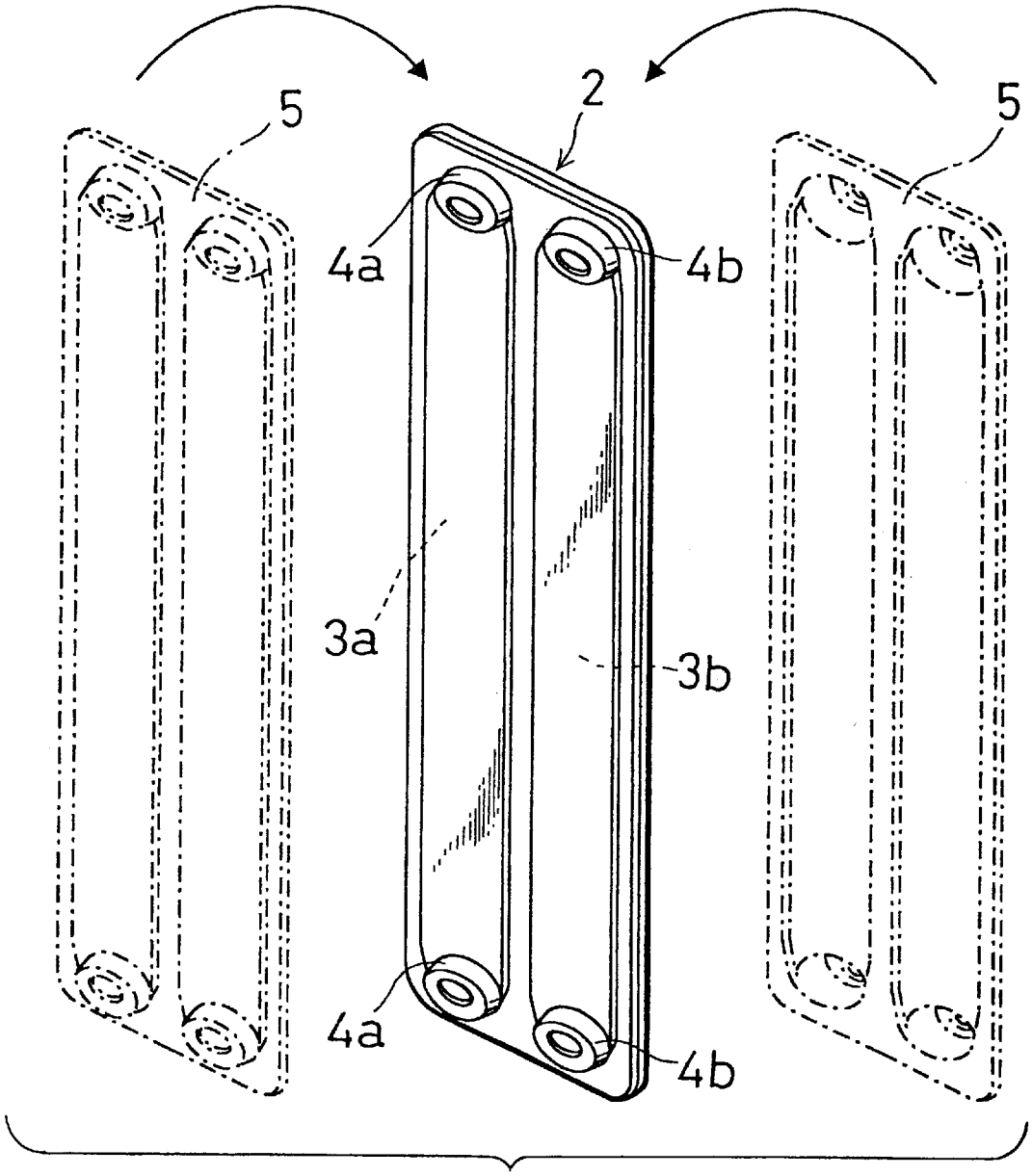
FIG.23 PRIOR ART
FIG. 23 is a perspective view of a tubular element of a conventional evaporator.
Figure 24:
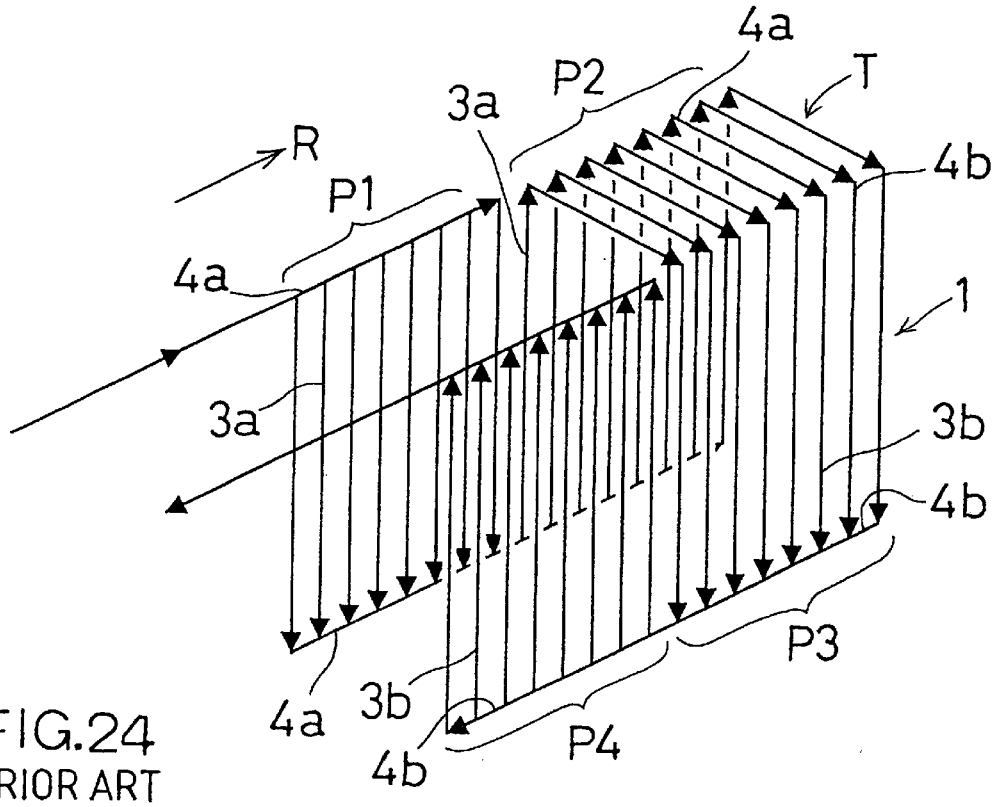
FIG.24 PRIOR ART
FIG. 24 is a perspective view showing a refrigerant flow passes of the conventional evaporator.
Figure 25:
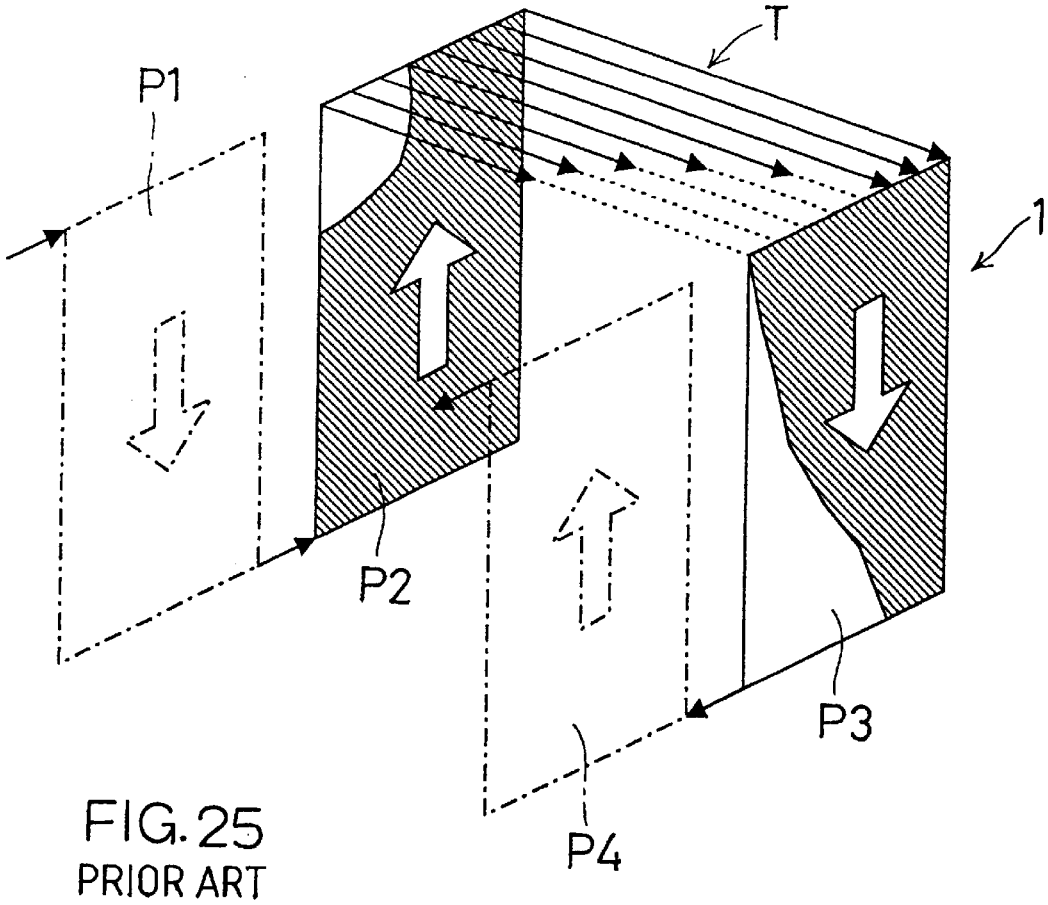
FIG.25 PRIOR ART
FIG. 25 is a perspective view showing a refrigerant flow in the conventional evaporator.

As shown in FIGS. 21 and 22, an evaporator formed by laminating sixteen (16) tubular elements was prepared. In this evaporator, the first pass P1 and the fourth pass P4 are formed by laminating nine (9) pieces of the aforementioned first tubular elements 21, and the second pass P2 and the third pass P3 are formed by laminating seven (7) pieces of the aforementioned second and third tubular elements 22 and 23.

In this comparative example, although the aforementioned third tubular element 23 having a semi-restricting passage 43 at the turn portion T is disposed at the left end of the second and third passes P2 and P3, the semi-restricting passage 43 is different from the refrigerant flow restricting portion according to the present invention as mentioned above.

EVALUATION

The cooling performance and the passage resistance of each of the aforementioned evaporators disposed vertically (in a wind tunnel) have been evaluated according to JIS (Japanese Industrial Standard) D 1618. The results of evaluations are shown in Table 1.

TABLE 1

| | Cooling performance | Passage resistance |
|---|---|---|
| Inventive example No. 1 | 102% | 96% |
| Inventive example No. 2 | 99% | 96% |
| Inventive example No. 3 | 103% | 94% |
| Inventive example No. 4 | 104% | 94% |
| Comparative example | 100% | 100% |

$Va$=480 $m^3$/h, $Rr$=130 kg/h

As will be apparent from the above Table 1, as compared to the evaporator according to the comparative example, the cooling performance of the evaporators according to the example Nos. 1, 3 and 4 can be improved, and the passage resistance thereof can be decreased. Especially, in the evaporators according to the inventive examples Nos. 3 and 4, the cooling performance can be improved by 3 to 4% and the passage resistance can be decreased by 6% or more, as compared to the evaporator according to the comparative example.

In the evaporator according to the inventive example No. 2, the passage resistance can be decreased by about 4%, as compared to the evaporator according to the comparative example.

This application claims priority to Japanese Patent Application No. H11-281024 filed on Oct. 1, 1999, the disclosure of which is incorporated by reference in its entirety.

It should be recognized that the terms and expressions used here are used for explanation and are not used for definitely interrupting, any equivalents of features shown and described here should not be precluded, and various modifications within the scope of claimed invention are allowed.

What is claimed is:

1. A laminate-type heat exchanger, comprising:

a core formed by a plurality of plate-shaped tubular elements laminated in a thickness direction thereof, a laminate direction of said plurality of tubular elements being defined as a width direction of said core, one side of said core in the laminating direction being defined as a first side, and the other side thereof being defined as a second side, wherein each of said plurality of plate-shaped tubular elements is provided with at least two refrigerant passages extending in a longitudinal direction thereof, said at least two refrigerant passages being arranged in a fore and aft direction of said core, and wherein said core include:

a plurality of passes each formed by a prescribed number of said refrigerant passages arranged in the width direction of said core;

a turn portion which is formed by one longitudinal end portions of said tubular elements constituting a prescribed pass among said plurality of passes and located between said prescribed pass and an adjacent pass facing to said prescribed pass in the fore and aft direction of said core, said turn portion introducing a refrigerant flowed through said prescribed pass into said adjacent pass;

a refrigerant flow resisting portion provided at said turn portion to restrict a refrigerant flow in said turn portion;

wherein a part of said turn portion constitutes a restricting pass which restricts a refrigerant flow, and the remaining part of said turn portion constitutes a free pass which does not restrict a refrigerant flow, and wherein said restricting pass constitutes said refrigerant flow resisting portion.

2. The laminate-type heat exchanger as recited in claim 1, wherein said prescribed pass includes a refrigerant inlet portion for introducing a refrigerant thereinto, said refrigerant inlet portion being located at a side portion of said prescribed pass on the first side of said core, and wherein said refrigerant flow resisting portion is provided at a side portion of said turn portion on the second side of said core.

3. The laminate-type heat exchanger as recited in claim 1, wherein said restricting pass includes a semi-restricting passage which partially restricts a refrigerant flow and an interrupting passage which interrupts a refrigerant flow.

4. The laminate-type heat exchanger as recited in claim 3, wherein said semi-restricting passage has one half a cross-sectional area of said free passage.

5. The laminate-type heat exchanger as recited in claim 1, wherein a passage of said turn portion located at a side of said prescribed pass on the first side of said core constitutes said free pass.

6. The laminate-type heat exchanger as recited in claim 1, wherein each of said plurality of tubular elements is provided with two refrigerant passages, wherein said refrigerant passages of said tubular elements forming one half of said core on the first side of said core form a first pass and a fourth pass, wherein said refrigerant passages of said tubular elements forming the other half of said core on the second side of said core form a second pass and a third pass, and wherein said turn portion is disposed between said second pass and said third pass.

7. The laminate-type heat exchanger as recited in claim 6, wherein said refrigerant flow restricting portion is provided at a part of said turn portion on the second side of said core.

8. The laminate-type heat exchanger as recited in claim 6, wherein said restricting pass is constituted by a first tubular element from a second side of said turn portion on the second side of said core.

9. The laminate-type heat exchanger as recited in claim 8, wherein a part of said turn portion on the first side of said turn portion constitutes said free pass.

10. The laminate-type heat exchanger as recited in claim 6, wherein each of first, fourth and fifth tubular elements forming said turn portion from a second side thereof on the second side of said core is provided with said refrigerant flow restricting portion.

11. The laminate-type heat exchanger as recited in claim 6, wherein each of the first, second and third tubular elements from a second side thereof on the second side of said core is provided with said refrigerant flow restricting portion.

* * * * *